US007063244B2

(12) United States Patent
Lee et al.

(10) Patent No.: US 7,063,244 B2
(45) Date of Patent: Jun. 20, 2006

(54) INTEGRATED RETRACTABLE BELT CLIP

(75) Inventors: Raymond Lee, Hong Kong (HK); Zheng Jun Wang, Guangdong (CN)

(73) Assignee: VTech Telecommunications Limited, Tai Po (HK)

( * ) Notice: Subject to any disclaimer, the term of this patent is extended or adjusted under 35 U.S.C. 154(b) by 323 days.

(21) Appl. No.: 10/440,191

(22) Filed: May 19, 2003

(65) Prior Publication Data

US 2004/0129746 A1 Jul. 8, 2004

(30) Foreign Application Priority Data

Jan. 6, 2003 (CN) ..... 03103172

(51) Int. Cl.
*A45F 5/00* (2006.01)

(52) U.S. Cl. ..... 224/271; 24/3.12

(58) Field of Classification Search ..... 224/271, 224/272, 668, 269; 24/3.12, 3.11
See application file for complete search history.

(56) References Cited

U.S. PATENT DOCUMENTS

| | | | | |
|---|---|---|---|---|
| 4,111,343 | A * | 9/1978 | Selinko | 224/670 |
| 4,717,275 | A * | 1/1988 | Burkhardt, Jr. | 401/104 |
| 6,233,789 | B1 * | 5/2001 | Douglas | 24/3.12 |
| 6,421,885 | B1 * | 7/2002 | Mowers et al. | 24/3.12 |
| 2003/0093880 | A1 * | 5/2003 | Mangion et al. | 24/11 R |

FOREIGN PATENT DOCUMENTS

| | | | | |
|---|---|---|---|---|
| GB | 2213522 | * | 8/1989 | 224/668 |

* cited by examiner

*Primary Examiner*—Lien M. Ngo
(74) *Attorney, Agent, or Firm*—Pillsbury Winthrop Shaw Pittman LLP

(57) ABSTRACT

A clip construction is provided for an article housing, e.g., a cordless telephone housing, which is movable between a deployed position, and a retracted position, in which the surface of the clip is disposed flush with the outer surface of the housing.

25 Claims, 7 Drawing Sheets

KNOWN ART

KNOWN ART

INTEGRATED RETRACTABLE BELT CLIP

CROSS-REFERENCE TO RELATED APPLICATION

This application claims the benefits of Chinese Patent Application Number 03103172.2 which was filed with the Patent Office of the State Intellectual Property Office of the People's Republic of China on Jan. 6, 2003.

BACKGROUND OF THE INVENTION

1. Field of the Invention

The present invention relates to article housings, and in particular telephone handset housings for cordless telephones. The invention is more particularly directed to belt clip configurations for cordless telephone handset housings.

2. Background of the Invention

Belt clips for cordless (or cellular) telephone handset housings are known. Typically, such belt clips are in the form of a separately-formed member, which is attached to the handset, by being clipped or snapped in place.

Such belt clips can often be difficult to attach, or difficult to keep attached, to their respective handset housings. Even when intentionally separated from the handset, they can easily become misplaced.

It would be desirable to provide a belt clip for telephone handsets, which is integrated into the handset housing, so that it cannot become accidentally separated from the handset housing.

It would also be desirable to provide a belt clip for telephone handsets, that is retractable into the telephone handset so that it is unobtrusive when the telephone handset is not being suspended from a belt.

These and other desirable characteristics of the present invention will become apparent in view of the present specification and drawings.

SUMMARY OF THE INVENTION

The present invention can be implemented in any article housing. For example, the present invention can be included in any article (e.g., a cordless telephone) that a user can attach to an object (e.g., the user's belt). One specific implementation of the invention is to provide a retractable belt clip to a housing of an electronic device. The electronic device can be for example, a cordless telephone, a cellular telephone, a pager, a personal digital assistant, pocket PC, and the like.

One embodiment of the invention provides a belt clip for a housing of an article. The belt clip includes a clip arm that is connected to the housing. The clip arm moves between a retracted position and a deployed position. The clip arm is flush with the housing in the retracted position. The clip arm is elevated above the housing in the deployed position.

Preferably, the belt clip further include an engagement member. The engagement member is connected to the clip arm. The engagement member is moveable within the housing between the retracted position and the deployed position. In the retracted position, the clip arm connected to the engagement member is precluded from being able to hook onto an object. In the deployed position, the clip arm connected to the engagement member is enabled to hook onto an object.

Preferably, the belt clip includes a depression disposed in the housing. The depression has a depth sufficient so that when the engagement member is in the retracted position, the clip arm is received within the depression to such an extent that an external surface of the clip arm is substantially flush with adjacent surfaces of the housing.

Preferably, the belt clip includes a structure for releasably locking the engagement member in the retracted position.

Preferably, the belt clip includes a structure for releasably locking the engagement member in the deployed position.

Preferably, the belt clip includes a stop structure disposed in the housing for precluding undesired overextension of the engagement member.

Another embodiment of the invention provides a belt clip apparatus for a housing of an article. The belt clip apparatus of the invention includes a clip arm, an engagement member and at least one sliding plate. The clip arm is operably configured to hook onto an object. The object can be, for example, a belt worn by a user.

The engagement member is connected to the clip arm. The engagement member is connected to the at least one sliding plate. The at least one sliding plate is captured by at least one guide rib disposed in the housing.

The engagement member is moveable within the housing between a retracted position and a deployed position. In the retracted position, the clip arm connected to the engagement member is precluded from being able to hook onto the object. In the deployed position, the clip arm connected to the engagement member is enabled to hook onto the object.

Preferably, the belt clip apparatus can include a depression disposed in the one of the front half and the back half, the depression having a depth sufficient so that when the engagement member is in its retracted position, the clip arm is received within the depression to such an extent that an external surface of the clip arm is substantially flush with adjacent surfaces of the housing.

Preferably, the belt clip apparatus can include a structure for releasably locking the engagement member in its retracted position. Preferably, the structure for releasably locking the engagement member in its retracted position includes a detent and a first notch. The detent is preferably a resiliently biased, movable detent that is mounted in the housing. The first notch is preferably disposed in the engagement member. The first notch is preferably configured to receive the resiliently biased movable detent when the engagement member is moved to its retracted position.

Preferably, the resiliently biased, movable detent is operably configured to resistively yield and vacate the first notch, when force is applied to the engagement member, in excess of a predetermined amount, toward moving the engagement member away from its retracted position.

Preferably, the belt clip apparatus can include a structure for releasably locking the engagement member in its deployed position. Preferably, the structure for releasably locking the engagement member in its deployment position includes a detent and a second notch. Preferably, the detent is a resiliently biased, movable detent that is mounted in the housing. Preferably, the second notch is disposed in the engagement member. Preferably, the second notch is configured to receive the resiliently biased movable detent, when the engagement member is moved to its deployed position.

Preferably, the resiliently biased, movable detent being is operably configured to resistively yield and vacate the second notch, when force is applied to the engagement member, in excess of a predetermined amount, toward moving the engagement member away from its deployed position.

Preferably, the belt clip apparatus can include a structure for releasably locking the engagement member in its retracted position and for releasably locking the engagement member in its deployed position.

Preferably, the belt clip apparatus can include a stop structure disposed in the housing for precluding undesired overextension of the engagement member.

Preferably, the housing includes a front half and a back half. The at least one sliding plate includes two sliding plates emanating from oppositely disposed sides of the engagement member and the at least one rib comprises at least one rib disposed on each side of the one of the front half and the back half of the housing.

Preferably, the at least one rib disposed on each side of the one of the front half and the back half includes an upper rib disposed on each side of the one of the front half and the back half and a lower rib disposed on each side of the one of the front half and the back half, with one sliding plate captured between an upper rib and a lower rib.

Preferably, the at least one rib includes an upper rib and a lower rib, with the at least one sliding plate captured between the upper rib and the lower rib.

Preferably, the clip arm further includes a thumb receiving depression for facilitating movement of the engagement member from its retracted position to its deployed position.

Another preferred embodiment of the invention provides an article that includes a housing, at least one guide rib, at least one sliding plate, an engagement member, and a clip arm. The housing has a front half and a back half. The at least one guide rib is disposed on one of the front half of the housing and the back half of the housing. The at least one sliding plate is captured by the at least one guide rib. The engagement member is connected to the at least one sliding plate. When the front half of the housing is juxtaposed against the back half of the housing, the engagement member is captured within the housing. The clip arm is connected to the engagement member. The engagement member is moveable within the housing between a retracted position and a deployed position. In the retracted position, the clip arm connected to the engagement member is precluded from being able to hook onto an object. In the deployed position, the clip arm connected to the engagement member is enabled to hook onto an object.

Preferably, the article includes a depression disposed in the one of the front half and the back half. The depression preferably have a depth sufficient so that when the engagement member is in its retracted position, the clip arm is received within the depression to such an extent that an external surface of the clip arm is substantially flush with adjacent surfaces of the one of the front half and the back half in which the depression is disposed.

Preferably, the at least one sliding plate includes two sliding plates emanating from oppositely disposed sides of the engagement member and the at least one rib comprises at least one rib disposed on each side of the one of the front half and the back half.

Preferably, the at least one rib disposed on each side of the one of the front half and the back half includes an upper rib disposed on each side of the one of the front half and the back half and a lower rib disposed on each side of the one of the front half and the back half, with one sliding plate captured between an upper rib and a lower rib.

Preferably, the at least one rib includes an upper rib and a lower rib, with the at least one sliding plate captured between the upper rib and the lower rib.

Preferably, the clip arm further includes a thumb receiving depression for facilitating movement of the engagement member from its retracted position to its deployed position.

DETAILED DESCRIPTION OF THE DRAWINGS

While this invention is susceptible of embodiment in many different forms, the drawings shown and the description below describe several specific embodiments, with the understanding that the present disclosure is to be considered as an exemplification of the principles of the invention and is not intended to limit the invention to the embodiments illustrated.

Figure 2:
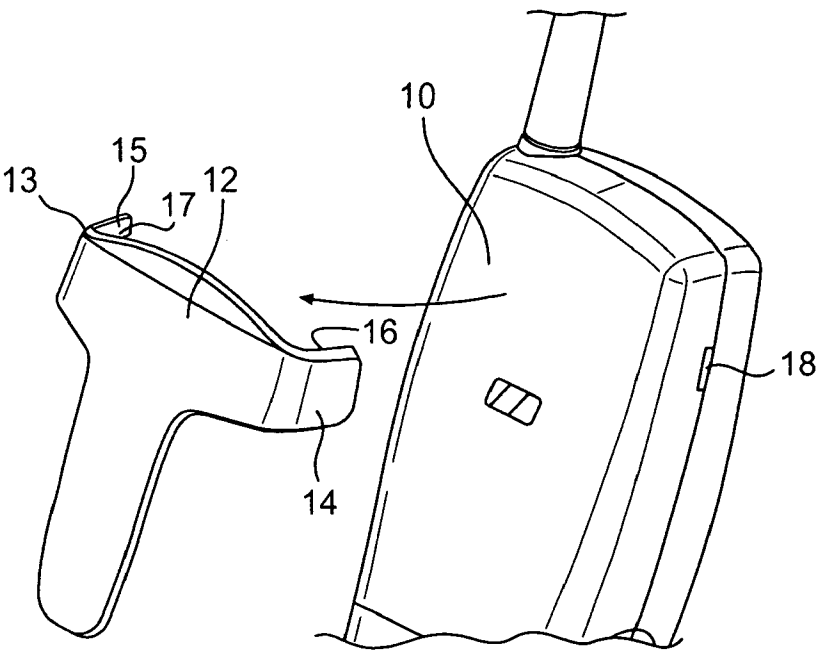
FIG. 2 is a perspective view of a known cordless telephone handset showing the removable belt clip separated from the handset housing.
Figure 1:
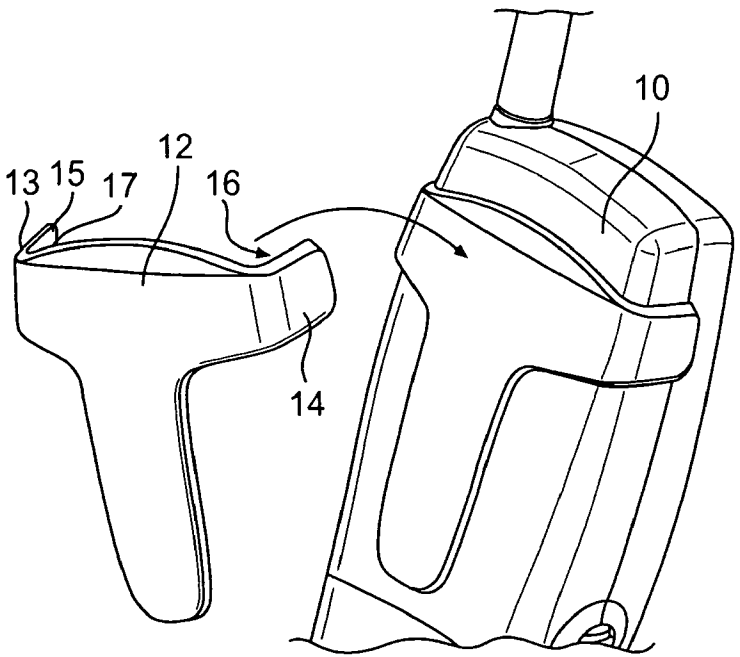
FIG. 1 is a perspective view of a known cordless telephone handset showing the placement of a removable belt clip therefor.

FIGS. 1 and 2 illustrate a known cordless telephone handset housing 10 of the type configured for receipt of a removable spring-type belt clip 12. Typically, clip 12 is provided with two arms 13, 14 that are formed of resilient material, and having opposing inside surfaces 15, 16 with small bumps (e.g., bump 17) configured to be received in corresponding recesses (e.g., recess 18) in housing 10, usually at or near the point of greatest width of the housing, typically near the part line between the two molded halves of housing 10. The distance between opposing inside surfaces 15, 16 is less than the width of housing 10 at the recesses, so that arms 13, 14 must be sprung slightly, to permit them to be pushed onto housing 10, until the bumps are received in the recesses. The remaining tension in arms 13, 14 cause clip 12 to maintain a grip on housing 10.

As mentioned hereinabove, such known belt clips are detachable. Accordingly, upon initial purchase and set up of such telephone, assembly of the belt clip to the cordless telephone handset is required. As the conventional belt clip is theoretically detachable, the belt clip may often be stored separate from the handset, and may be difficult to locate when its use is desired. Often, the clips are not sized properly and if not fabricated according to specified tolerances, may be too tight to be put on the handset, or may be too loose to stay on. In addition, due to wear and tear and material fatigue, a belt clip that has been in use and has been attached and removed numerous times may, over time, be less firm in its grip, and may be prone to spontaneous undesired separation from the handset.

Preferred embodiments of the present invention avoids the foregoing potential drawbacks through the use of a slide mechanism. The slide mechanism enables the rapid and assured deployment or retraction of the belt clip. The belt clip of the present invention is a permanent part of the handset, but can be unobtrusively stowed, when the handset is being used, or when it is being stored on its cradle, or simply set down.

In accordance with the present invention, the belt clip can be advantageously shaped to conform to the contour of the handset. The belt clip may be varied from handset configuration to handset configuration. Because the belt clip is an integrated part of the handset housing, even after use, while the retraction/deployment action of the clip may become less firm over time, undesired separation of the clip from the handset still will not occur in the absence of total failure of the clip.

Figure 4:
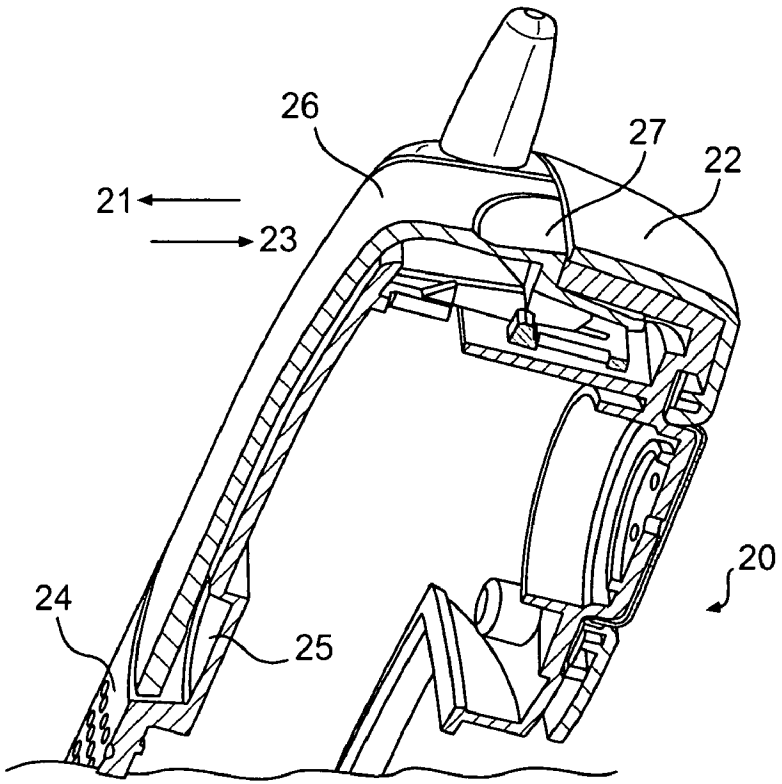
FIG. 4 is a sectional view of the handset housing of FIG. 3.
Figure 3:
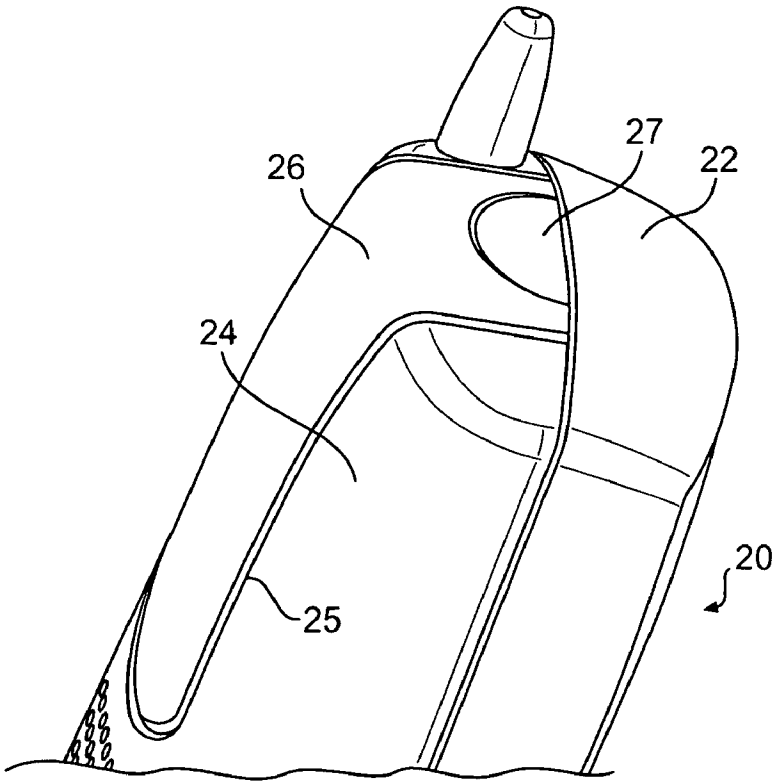
FIG. 3 is a perspective view of a cordless telephone handset housing, according to a preferred embodiment of the present invention, showing the belt clip in its retracted position.
Figure 6:
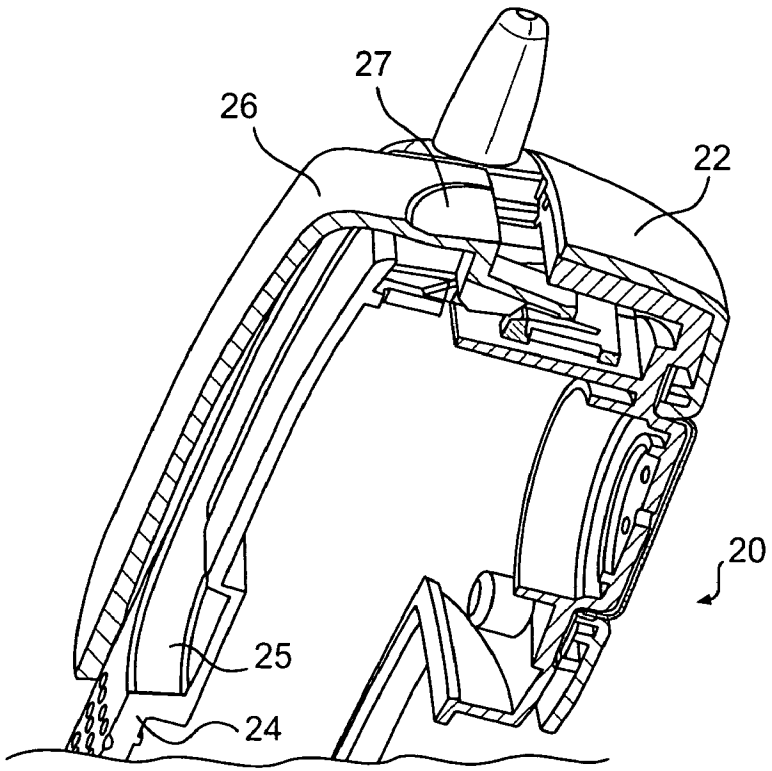
FIG. 6 is a sectional view of the handset housing of FIG. 5.

FIG. 3 illustrates a handset housing 20 having a front half 22 and a back half 24, with retractable clip 26 shown in its retracted position. As can be seen, clip 26 fits into recess 25 (which is occupied by clip 26) in back half 24, so that the outer surface of clip 26 is flush with the outer surface of back half 24. Recess 25 is more clearly seen in FIG. 4, in which the view of FIG. 3 is shown in section. Clip 26 also includes thumb depression 27. Thumb depression 27 enables a user's thumb to push outwardly in direction 21 against the top of the clip 26.

Figure 5:
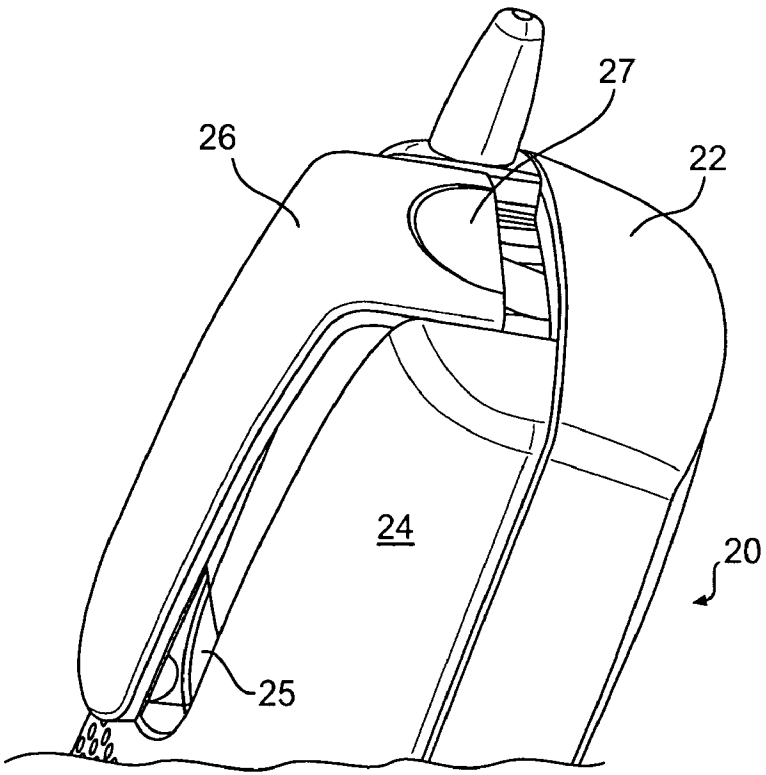
FIG. 5 is a perspective view of the cordless telephone handset housing, according to the embodiment of FIG. 3, showing the belt clip in its deployed position.

FIG. 5 illustrates handset housing 20, with front half 22, back half 24 and retractable clip 26. Typically, front half 22 includes a keypad and a notional mouthpiece for the handset, while back half 24 encompasses the rear of the telephone, where the battery cover is often positioned. While in other embodiments of the invention, the belt clip may face toward the front of the telephone, typically, and in the illustrated embodiment of the invention, clip 26 is received in recess 25. As shown in FIG. 5, clip 26 is in its deployed position. Clip 26 is pushed outwardly from recess 25 in direction 21 (see FIG. 4) to the deployed position. As described in further detail herein, clip 26 in a preferred embodiment, while capable of being pushed out from recess 25, cannot be pushed completely out of housing 20. This can be done in a number of ways. For example, inter-engaging structures can be provided at the top of clip 26 and at the top of the interior of back half 24 to avoid clip 26 from being completely pushed out from recess 25.

FIGS. 7, 8*a*, 8*b*, 9, 10, 11, and 12 illustrate the cooperative structures in the front half 22, back half 24 and clip 26, that permit the controlled deployment of the clip 26. It is to be understood that while particular shapes are provided for front half 22, back half 24 and clip 26, these are indicated merely for illustrative purposes. The present invention is applicable to other configurations of handset housings, and the particular contours of particular features may be readily modified by one of ordinary skill in the art of telephone handset design, having the present disclosure before them, without departing from the scope of the present invention. It is also understood that the principles of the present invention are not affected by the choice of materials employed in the structures of the front half 22, back half 24 or clip 26, which may be metal, plastic, or any other suitable material.

In addition, those internal structures shown, which are not part of the retraction/deployment structures of the housing, are shown for illustrative purposes and are understood to be variable from telephone handset to telephone handset. Further, the specific retraction/deployment structures may be modified by one of ordinary skill in the art to accommodate telephone handsets, or any articles, of different configurations, without departing from the scope of the present invention.

Figure 7:
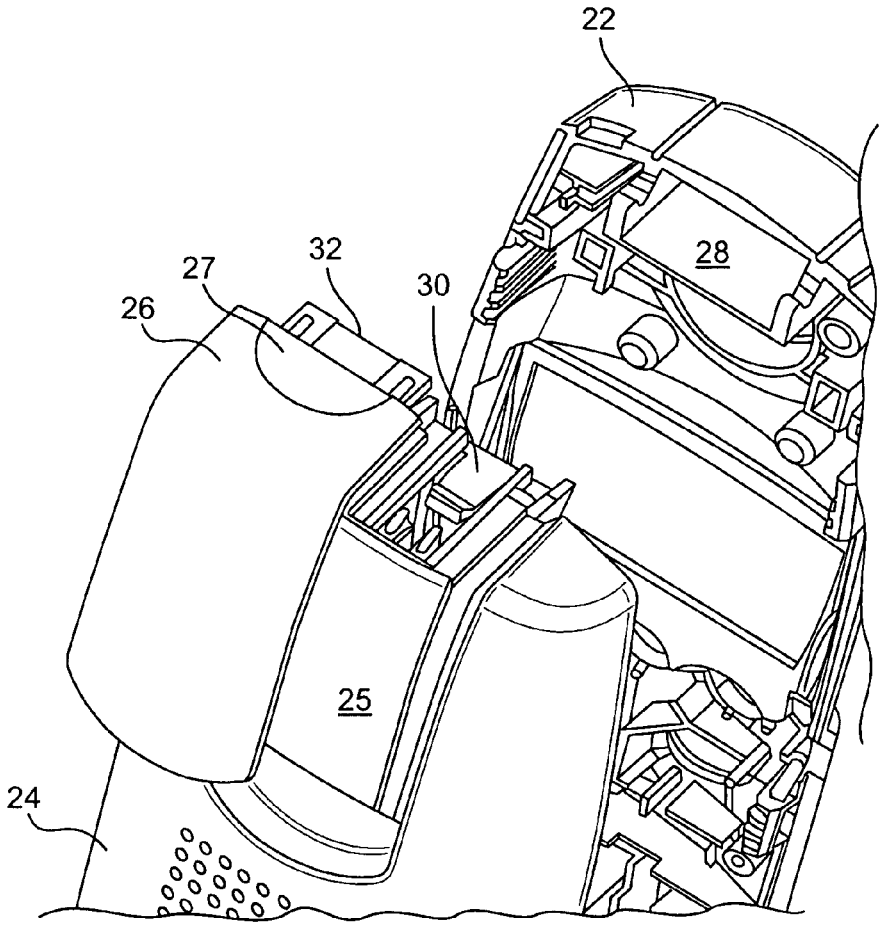
FIG. 7 is a perspective exploded view of the handset housing shown in FIG. 3.
Figure 8A:
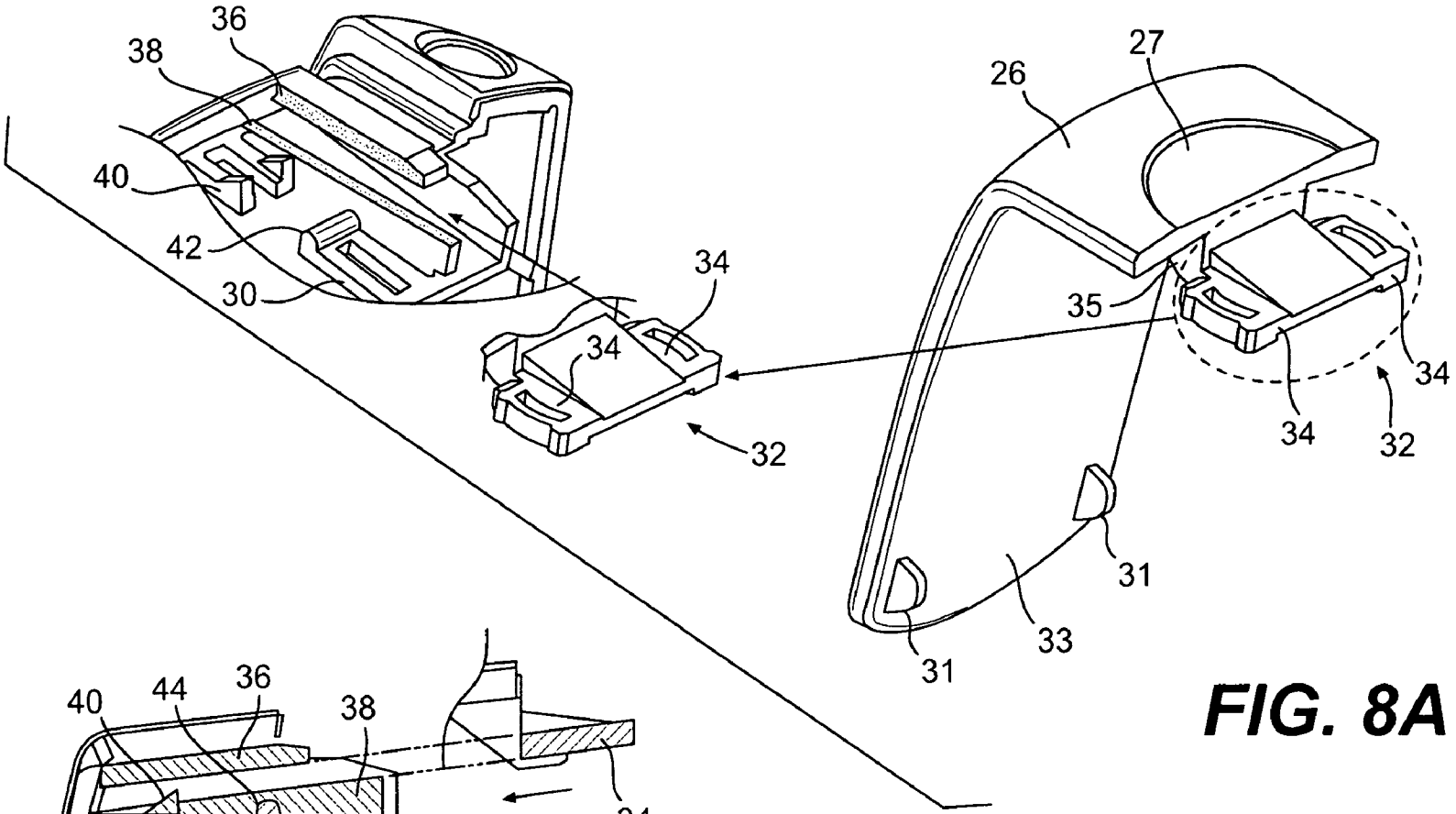
FIG. 8*a* is a perspective fragmentary sectional view of a handset housing according to the present invention, showing how the belt clip is engaged by the housing structure.

FIG. 7 illustrates front half 22 separated from back half 24 to reveal cavity 28. Cavity 28 is provided to receive engagement member 32 (more clearly seen in FIG. 8*a*) of clip 26, when clip 26 is in its retracted position. As shown in FIG. 8*a*, engagement member 32 is connected to arm 33 of clip 26 by connecting web 35. In FIG. 7, clip 26 is shown to be elevated above back half 24 of housing 20, to reveal spring-flexing catch 30. Clip arm 33 may further include inwardly projecting tabs 31 as shown in FIG. 8*a*. Tabs 31 is configured to encircle or engage the bottom edge of a belt or other garment or other object onto which arm 33 is hooked.

Figure 8B:
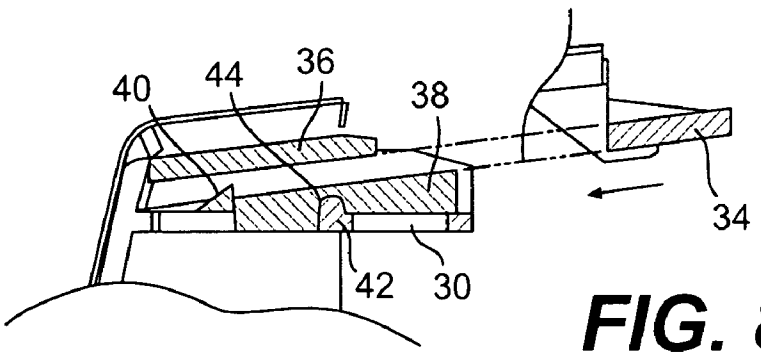
FIG. 8*b* is a fragmentary side elevation, in section of the handset housing according to the present invention.

FIGS. 8*a* and 8*b* illustrate the cooperative elements of clip 26 and back half 24. Engagement member 32 of clip 26 includes sliding plates 34. Sliding plates 34 are aligned with, and slidingly receivable between ribs 36, 38, which are located on both sides of back half 24, one set for each sliding plate 34. Spring-flexing catch 30 includes upwardly extending lip 42, which is configured to engage a downwardly extending ridge 44 (more clearly seen in FIG. 10). Extending ridge 44 is located on the underside of the central portion of engagement member 32.

Figure 9:
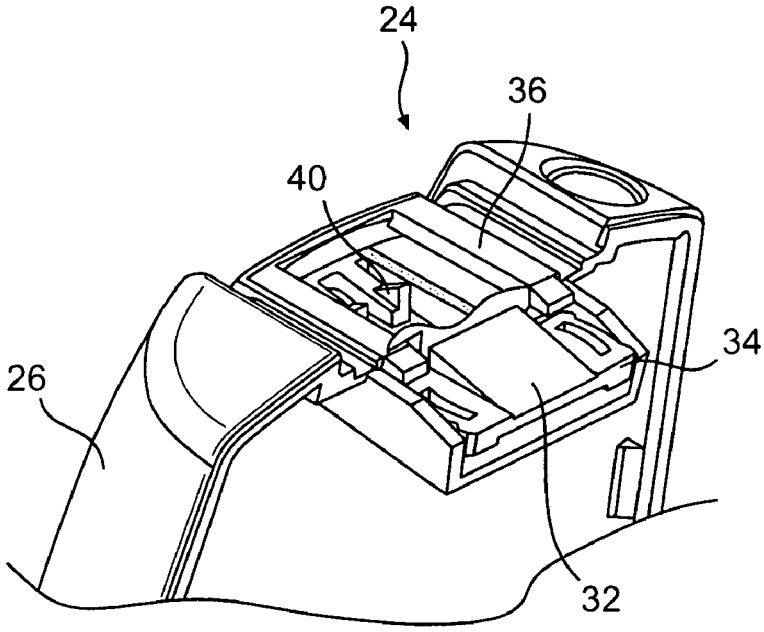
FIG. 9 is a perspective fragmentary view of the back half of the handset housing according to the present invention, showing a portion of the belt clip structure, in position when the belt clip is retracted.
Figure 10:
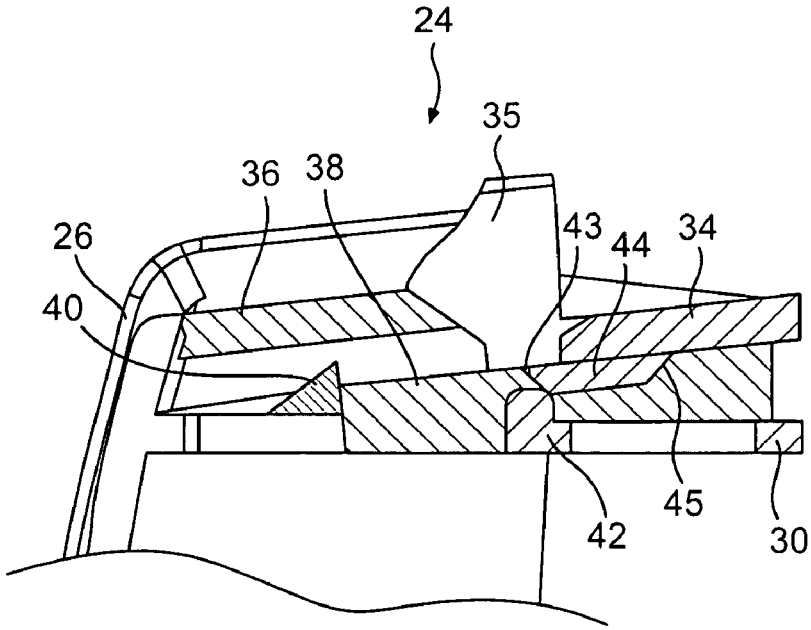
FIG. 10 is a fragmentary side elevation, in section, of the back half of the handset housing of FIG. 9.
Figure 11:
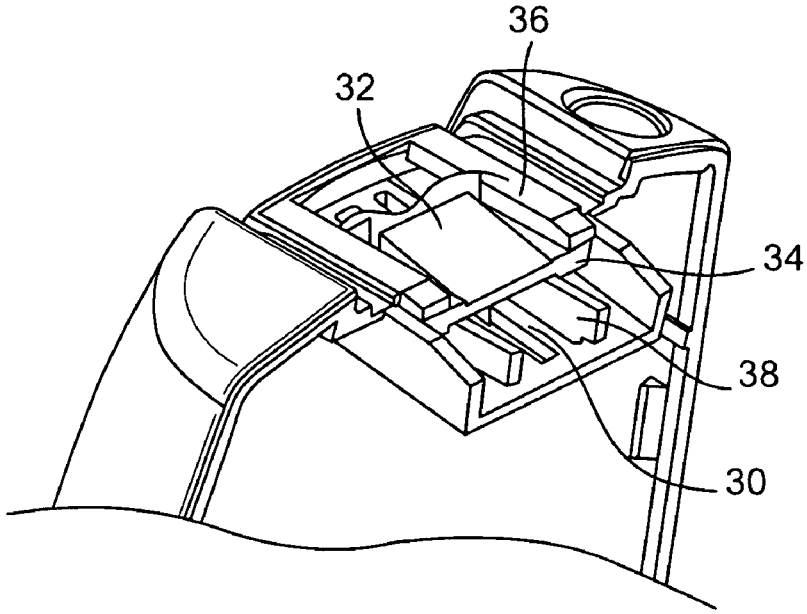
FIG. 11 is a perspective fragmentary view of the back half of the handset housing according to the present invention, showing a portion of the belt clip structure, in position when the belt clip is deployed.
Figure 12:
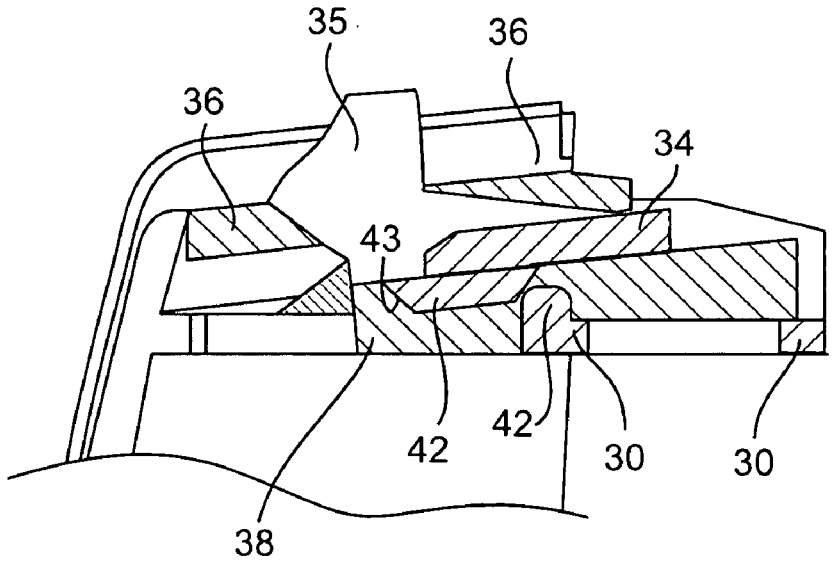
FIG. 12 is a fragmentary side elevation, in section, of the back half of the handset housing of FIG. 11.

Clip 26 is in its retracted position in the illustrations of FIGS. 9 and 10. In those views, back half 24 is to the left as seen by the observer and front half 22 (not shown) would be to the right. The rightmost portions of spring-flexing catch 30 and ribs 36, 38 extend toward and, if desired, into cavity 28 of front half 22. When placed together, internal structures of front half 22 and back half 24 are provided to isolate the cooperating portions of the two halves and of clip 26 from the interior region of the housing 22 in which the functional electronics are housed. The isolation ensures that operation of clip 26 cannot expose or compromise the internal workings of the telephone.

When clip 26 is in its retracted position, ridge 44 is to the right of lip 42 and arm 33 is received within recess 25. To deploy clip 26, pressure is exerted, e.g., via a thumb, pressing into recess 27 (see FIGS. 3, 8*a*), down and to the left in direction 21, so that as engagement member 32 (FIG. 8*a*) moves to the left (in direction 21), the left-hand inclined face 43 of ridge 44 (which defines a notch) pushes against the upper surface of lip 42. Lip 42 is pushed downward as spring-flexing catch 30 is forced to bend downward. The flat bottom side of ridge 44 slides along the top of lip 42, as sliding plates 34 moves to the right along ribs 36, 38. Eventually, ridge 44 passes from the right to the left of lip 42, which moves upward under the bias of bent catch 30, preferably configured to provide both a tactile and audible "click" to provide a positive feedback that the clip 26 has been fully deployed. Stops 40 are provided to prevent overextension of clip 26 relative back half 24. Because sliding pates 34 are trapped between ribs 36 and 38, clip 26 cannot be removed from housing, 20, unless front half 22 is separated from back half 24, or unless clip 26 suffers failure along web 35 or between sliding plates 34 and the central portion of engagement member 32.

To retract clip 26, pressure may be applied either at depression 27, or simply against the outer surface of arm 33, pushing clip 26 toward front half 22 in direction 23. Direction 23 is the opposite of direction 21. The front inclined face 45 of ridge 44 (which defines another notch) will bear against the upper surface of lip 42 and push catch 30 downwardly. As engagement member 32 moves to the right (in direction 23), the flat bottom of ridge 44 will move over the top of lip 42. Once ridge 44 has passed lip 42, the bias of catch 30 will cause lip 42 to move upward rapidly to the position shown in FIGS. 9 and 10, again, being preferably so configured that a tactile and audible "click" is provided for positive feedback.

As described, the preferred embodiment of the present invention provides a clip which is retractable to a position flush with the surface of the telephone housing, to be aesthetically unobtrusive and provide a sleek profile to the telephone. In addition, the clip cannot become separated under normal use. Even after extended use, while potentially operating with a less crisp function, the clip will nevertheless continue to provide positive feedback upon deployment and retraction, and will not become separated from the housing. The present invention also includes the advantage of improving packaging of the commercial product by eliminating the need for providing separate discrete packaging space for an albeit removable, but permanently protruding clip structure.

The foregoing disclosure of the preferred embodiments of the present invention has been presented for purposes of illustration and description. It is not intended to be exhaustive or to limit the invention to the precise forms disclosed. Many variations and modifications of the embodiments described herein will be apparent to one of ordinary skill in the art in light of the above disclosure. The scope of the invention is to be defined only by the claims appended hereto, and by their equivalents.

What is claimed is:

1. A housing of an article comprising:

a clip arm being connected to the housing for moving between a retracted position and a deployed position;

an engagement member configured to capture the clip arm within the housing, wherein the engagement member is moveable within the housing as the clip arm is moved between the retracted and deployed positions;

a downwardly extending ridge disposed in the engagement member; and a structure for releasably locking the engagement member in at least one of the retracted and deployed positions, wherein the structure comprises a resiliently biased, movable detent that engages the downwardly extending ridge in one of the retracted and deployed positions.

2. The housing of claim 1, wherein when the clip arm is in the retracted position the clip arm is flush with the housing.

3. The housing of claim 1, further comprising a depression disposed in the housing, the depression having a depth sufficient so that when the engagement member is in the retracted position, the clip arm is received within the depression to such an extent that an external surface of the clip arm is substantially flush with adjacent surfaces of the housing.

4. The housing of claim 1, wherein the structure is configured for releasably locking the engagement member in the retracted position.

5. The housing of claim 1, wherein the structure is configured for releasably locking the engagement member in the deployed position.

6. The housing of claim 1, further comprising a stop structure disposed in the housing for precluding undesired overextension of the engagement member.

7. A housing of an article comprising:

a clip arm operably configured to hook onto an object;

an engagement member connected to the clip arm, wherein the engagement member is moveable within the housing between a retracted position in which the clip arm connected to the engagement member is precluded from being able to hook onto the object, and a deployed position in which the clip arm connected to the engagement member is enabled to hook onto the object;

at least one sliding plate connected to the engagement member, wherein the at least one sliding plate is captured by at least one guide rib disposed in the housing; and a structure for releasably locking the engagement member in at least one of its retracted and deployed positions, wherein the structure comprises a resiliently biased, movable detent mounted in the housing, and a downwardly extending ridge disposed in the engagement member, wherein the downwardly extending ridge is configured to receive the resiliently biased, movable detent when the engagement member is moved from one of its retracted and deployed positions to the other of its retracted and deployed positions.

8. The housing of claim 7, further comprising a depression disposed in the housing, the depression having a depth sufficient so that when the engagement member is in its retracted position, the clip arm is received within the depression to such an extent that an external surface of the clip arm is substantially flush with adjacent surfaces of the housing.

9. The housing of claim 7, wherein the downwardly extending ridge includes a first inclined face and a second inclined face.

10. The housing of claim 9, wherein the first inclined face is configured to receive the resiliently biased, movable detent when the engagement member is moved to its retracted position and the second inclined face is configured to receive the resiliently biased, movable detent when the engagement member is moved to its deployed position.

11. The housing of claim 9, wherein the first inclined face is configured to receive the resiliently biased, movable detent when the engagement member is moved to its deployed position the second inclined face is configured to receive the resiliently biased, movable detent when the engagement member is moved to its retracted position.

12. The housing of claim 7, wherein the structure is configured for releasably locking the engagement member in both of its retracted and deployed positions.

13. The housing of claim 9, wherein the first inclined face is configured to receive the resiliently biased, movable detent when the engagement member is moved to its retracted position; and wherein the second inclined face is configured to receive the resiliently biased, movable detent when the engagement member is moved to its deployed position.

14. The housing of claim 7, further comprising a stop structure disposed in the housing for precluding undesired overextension of the engagement member.

15. The housing of claim 7, wherein the housing comprises a front half and a back half, wherein the at least one sliding plate comprises two sliding plates emanating from oppositely disposed sides of the engagement member and the at least one rib comprises at least one rib disposed on each side of the one of the front half of the housing and the back half of the housing.

16. The housing of claim 15, wherein the at least one rib disposed on each side of the one of the front half and the back half comprises an upper rib disposed on each side of the one of the front half and the back half and a lower rib disposed on each side of the one of the front half and the back half, with one sliding plate captured between an upper rib and a lower rib.

17. The housing of claim 7, wherein the at least one rib comprises an upper rib and a lower rib, with the at least one sliding plate captured between the upper rib and the lower rib.

18. The housing of claim 7, wherein the clip arm further comprises a thumb receiving depression for facilitating movement of the engagement member from its retracted position to its deployed position.

19. An article having a housing with a front half and a back half comprising:

at least one sliding plate captured by the at least one guide rib;

an engagement member connected to the at least one sliding plate so that when the front half of the housing is juxtaposed against the back half of the housing the engagement member is captured within the housing;

a clip arm connected to the engagement member, the engagement member being moveable within the housing between a retracted position in which the clip arm connected to the engagement member is precluded from being able to hook onto an object, and a deployed position in which the clip arm connected to the engagement member is enabled to hook onto an object; and a structure for releasably locking the engagement member in at least one of its retracted and deployed positions, wherein the structure comprises a resiliently biased, movable detent mounted in the housing, and a downwardly extending ridge disposed in the engagement member, wherein the downwardly extending ridge is configured to receive the resiliently biased, movable detent when the engagement member is moved from one of its retracted and deployed positions to the other of its retracted and deployed positions.

20. The article of claim 19, further comprising a depression disposed in the one of the front half of the housing and the back half of the housing, the depression having a depth sufficient so that when the engagement member is in its retracted position, the clip arm is received within the depression to such an extent that an external surface of the clip arm is substantially flush with adjacent surfaces of the one of the front half and the back half in which the depression is disposed.

21. The article of claim 19, wherein the at least one sliding plate comprises two sliding plates emanating from oppositely disposed sides of the engagement member and the at least one rib comprises at least one rib disposed on each side of the one of the front half and the back half.

22. The article of claim 19, wherein the at least one rib disposed on each side of the one of the front half and the back half comprises an upper rib disposed on each side of the one of the front half and the back half and a lower rib disposed on each side of the one of the front half and the back half, with one sliding plate captured between an upper rib and a lower rib.

23. The article of claim 19, wherein the at least one rib comprises an upper rib and a lower rib, with the at least one sliding plate captured between the upper rib and the lower rib.

24. The article of claim 19, wherein the clip arm further comprises a thumb receiving depression for facilitating movement of the engagement member from its retracted position to its deployed position.

25. The article of claim 19, further comprising at least one guide rib disposed in one of the front half of the housing and the back half of the housing.

* * * * *